United States Patent [19]

Kawamura et al.

[11] Patent Number: 4,465,751

[45] Date of Patent: Aug. 14, 1984

[54] ELECTROPHOTOGRAPHIC LIGHT-SENSITIVE MATERIALS

[75] Inventors: Kouichi Kawamura; Hideo Sato, both of Saitama, Japan

[73] Assignee: Fuji Photo Film Co., Ltd., Kanagawa, Japan

[21] Appl. No.: 444,118

[22] Filed: Nov. 24, 1982

[30] Foreign Application Priority Data

Nov. 27, 1981 [JP] Japan ..... 56-190235

[51] Int. Cl.[3] ..... G03G 5/14

[52] U.S. Cl. ..... 430/64; 430/539; 430/132

[58] Field of Search ..... 430/64, 62, 60, 61, 430/539, 132, 69

[56] References Cited

U.S. PATENT DOCUMENTS

| | | | |
|---|---|---|---|
| 3,682,632 | 8/1972 | Fumiaki et al. | 430/60 |
| 3,697,267 | 10/1972 | Uber et al. | 430/65 |
| 3,788,856 | 1/1974 | Paesschen et al. | 430/60 |
| 4,088,484 | 5/1978 | Okazaki et al. | 430/58 X |

*Primary Examiner*—John D. Welsh

*Attorney, Agent, or Firm*—Sughrue, Mion, Zinn, Macpeak and Seas

[57] ABSTRACT

An electrophotographic light-sensitive material is disclosed. The material is comprised of a conductive layer containing cuprous iodide and a photoconductive layer. The photoconductive and electrophotographic characteristics are improved by forming a gelatin interlayer between the conductive layer and the photoconductive layer. The electrophotographic light-sensitive material can be used with either positive polarity or negative polarity.

6 Claims, No Drawings

ELECTROPHOTOGRAPHIC LIGHT-SENSITIVE MATERIALS

FIELD OF THE INVENTION

This invention relates to electrophotographic light-sensitive materials, and more particularly to an electrophotographic light-sensitive material having improved semiconductivity and electrophotographic characteristics, which includes a light-sensitive layer having an gelatin inter layer between a conductive layer containing cuprous iodide and a photoconductive layer.

BACKGROUND OF THE INVENTION

Conductive supports for electrophotographic light-sensitive materials generally used include papers; aluminum plates; polymer films or papers which have metals vapor-deposited thereon such as aluminum or palladium; polymer films or papers having vapor-deposited thereon a semiconductor such as tin-doped indium oxide, or antimony-doped tin oxide; and polymer films containing cuprous iodide. An interlayer is often formed between such a support and the photoconductive layer formed thereon. The interlayer can have electric hindrance characteristics and is used to prevent the occurence of harmful electric co-action between a photoconductive layer and a conductive layer and for improving various electrophotographic characteristics such as dark decay, fatigue, light sensitivity, charging property, etc. Intermediate layers suitable for the purpose are discharged in various technical reports, e.g., U.S. Pat. Nos. 2,901,348; 3,573,906; 3,640,708; etc.

However, conventional materials for the interlayers may be effective with respect to reducing the occurence of dark decay and improving the charging property but is not always satisfactory with respect to increasing electrophotographic sensitivity. Also, in many cases, conventional materials for interlayers are soluble in a coating solvent for a photoconductive layer, such as toluene, xylene, methylene chloride, chloroform, tetrachloroethane, dichloroethane, chlorobenzene, tetrahydrofuran (THF), dioxane, cyclohexanone, etc., and further when a conductive layer disposed under the interlayer is a conductive layer of a binder dispersed type, e.g., a layer composed of cuprous iodide dispersed in a binder, the binder is soluble in a coating solvent for a photoconductive layer, which results in causing various troubles. More specifically, difficulties result from coating the photoconductive layer in that the interlayer may be destroyed by the coating solvent for the photoconductive layer and further the conductive layer coated under the layer may also be destroyed which reduces the electrophotographic sensitivity. Also, since the interlayer is locally intermixed with the photo-conductive layer, it is difficult to uniformly coat the photoconductive layer, thereby an ununiform and uneven photoconductive layer is formed. Thus, undesirable uneven charging occurring during an electrophotographic process, uneven density occurring during development, etc., may take place.

It is difficult to obtain a bipolar electrophotographic light-sensitive material having practically satisfactory properties using conventional materials for the interlayer. By the term "bipolar electrophotographic light-sensitive material" is meant an electrophotographic material which maintains a desired surface charged potential and has practical electrophotographic sensitivity under either positive or negative polar charges.

When using bipolar electrophotographic light-sensitive material, either normal development or a reversal development can be easily performed in the same electrophotographic process merely by changing the positive charge polarity and negative charge polarity using a developing toner having the same polarity. Accordingly, the electrophotographic light-sensitive material has a wide application range in electrophotography.

A gelatin layer is insoluble in a coating solvent for a photoconductive layer and hence it protects a conductive layer. Furthermore, the gelatin layer acts to prevent the intermixing of a positive carrier into a photoconductive layer from a conductive layer and also makes possible negative charging.

Also, since there is no local mixing between the photoconductive layer and gelatin layer, uneven coating does not occur.

SUMMARY OF THE INVENTION

The present invention provides an electrophotographic light-sensitive material which causes no reduction in sensitivity by destruction of a conductive layer and is capable of being used at both polarities. The material of the present invention is also a light-sensitive material having no uneven coating.

An object of this invention is to provide an electrophotographic light-sensitive material having improved photoconductive characteristics and electrophotographic characteristics by combining a gelatin layer as an interlayer between a conductive layer containing cuprous iodide and a photoconductive layer.

Another object of this invention is to provide an electrophotographic light-sensitive material having a high photosensitivity.

Still another object of this invention is to provide a bipolar electrophotographic light-sensitive material having photosensitivity with respect to both positive and negative charging.

Another object of this invention is to provide an electrophotographic light-sensitive material having an interlayer which does not destroy the conductive layer containing a polymer binder, is not destroyed during the coating of a photoconductive layer containing a polymer binder, and does not cause mixing with the photoconductive compositions of the photoconductive layer.

A further object of this invention is to provide an electrophotographic light-sensitive material having an interlayer which does not cause uneven coating in a thickness and in a composition during the coating of a photoconductive layer containing a polymer binder.

Yet another object of this invention is to provide an electrophotographic light-sensitive material having a gelatin interlayer which is capable of protecting a conductive layer composed of cuprous iodide dispersed in a polymer from an organic solvent.

According to this invention, there are provided:

(1) an electrophotographic light-sensitive material comprising a conductive layer containing cuprous iodide, a gelatin layer, and a photoconductive layer formed in that order, (2) the electrophotographic light-sensitive material described in (1) wherein the conductive layer is a layer composed of cuprous iodide particles dispersed in a polymer, and (3) the electrophotographic light-sensitive material described in (1) wherein the conductive layer is formed on a support through a subbing layer composed of a hydrophobic polymer.

DESCRIPTION OF THE PREFERRED EMBODIMENT

The electrophotographic light-sensitive materials of this invention do not require a support when the conductive layer containing cuprous iodide itself is formed as a layer having sufficient mechanical strength so as to provide a self supporting property. However, in many cases, the conductive layer is formed on a proper support. When a support is used, specific examples of useful support materials include papers, polymer films (e.g., a polyethylene terephthalate film (PET film), a film of polycarbonate of bisphenol A, a cellulose diacetate film (DAC film), a cellulose triacetate film (TAC film), a cellulose acetate porpionate film, a cellulose acetate butyrate film, a regenerated cellulose film, a polyethylene film, a polypropylene film, a polyvinyl chloride film, etc.), and cloths. The support materials may be properly selected according to the purpose and use of the electrophotographic light-sensitive material.

Cuprous iodide (copper (I) iodide) can be used in the form of colorless transparent or pure white masses, granules or crystalline or amorphous fine powder, preferably in the form of amorphous fine powder. The conductive layer containing cuprous iodide can be used as a layer composed of cuprous iodide molecularly dispersed in a water-insoluble polymer binder (thus, almost uniformly distributed therein) or a layer composed of cuprous iodide dispersed in a water-insoluble polymer binder as the crystalline or amorphous fine powder or granules thereof. The amount of cuprous iodide used is preferably 0.5 to 8 times by weight, more preferably 1.5 to 4 times by weight that of the binder.

In order to incorporate cuprous iodide in a water-soluble polymer binder, it is desirable to take advantage of the solubility of cuprous iodide in acetonitrile. In practice, the conductive layer containing cuprous iodide is formed on a support by coating (1) an acetonitrile solution of a polymer soluble in acetonitrile and cuprous iodide, (2) an acetonitrile dispersion having dispersed therein a polymer capable of being dispersed in acetonitrile and having dissolved therein cuprous iodide, or (3) an acetonitrile solution containing a small amount of an organic solvent miscible with acetonitrile together with a polymer and cuprous iodide dissolved therein, and then removing (i.e., drying) the acetonitrile (and, as the case may be, a small amount of the organic solvent miscible with the acetonitrile).

In place of using a support as described above, a conductive sheet containing cuprous iodide having a self supporting property may be used by itself. This type of sheet may be prepared by coating the aforesaid solution or dispersion on a temporary support which it can later be peeled from (e.g., a stainless steel sheet having a specularly finished surface, a nickel- or chromium-plated metal sheet, or a glass sheet or plate) followed by drying. The layer containing cuprous iodide is then peeled off from the temporary support.

A conductive layer containing cuprous iodide may be formed by other methods. For example, an acetonitrile solution of cuprous iodide may be coated on a support composed of a polymer capable of being dissolved in acetonitrile or being swelled by acetonitrile, or on a support having a layer of such a polymer formed on the surface thereon by coating. Alternatively, such a support may be immersed in an acetonitrile solution of cuprous iodide to permeate the acetonitrile solution of cuprous iodide into the surface portion of the support or into the polymer layer on a support. The acetonitrile is then removed leaving the fine particles of cuprous iodide in the surface portion of the support or in the polymer layer on the support. The amount of the cuprous iodide which presents within the layer after drying is 50 to 800 mg/m$^2$, preferably 200 to 600 mg/m$^2$.

Examples of the polymer soluble in acetonitrile include cellulose acetate propionate, cellulose acetate butyrate, nitrocellulose, ethylcellulose and polyvinyl acetate. Of the polymers, cellulose acetate butyrate is more preferably used.

Furthermore, cuprous iodide may be dispersed in a polymer binder by the method disclosed in Japanese Patent Publication No. 34,409/'75 and U.S. Pat. No. 3,245,833.

Gelatin used for the interlayer in this invention is gelatin purified to the same extent as that used for gelatino silver halide photographic emulsions. Practical examples of gelatin used for the interlayer include acid-treated gelatin, e.g., gelatin produced by an acid method, alkali-treated gelatin, e.g., gelatin produced by an alkali method, de-ionized gelatin, and gelatin derivatives (i.e., gelatins the amino group, imino group, hydroxy group, and carboxy group contained in the molecule of which was treated, for reformation and chemical modification thereof, with a compound having one group cable or reacting with the foregoing groups, such as isocyanates, acid chlorides, acid anhydrides, bromoacetates, phenylglycidyl ethers, vinylsulfones, N-allylvinylsulfonamides, maleinimides, acrylonitriles, polyalkyleneoxides, epoxy compounds, alkanesultones, and aliphatic or aromatic carboxylic acid esters).

A coating solution for the gelatin interlayer is prepared by dissolving gelatin in water (at about 10° C. to about 25° C.) or warm water (at about 25° C. to about 60° C.) ranging in preferable concentration of 0.5 to 10% by weight, more preferable concentration of 1 to 5% by weight. The coating solution for the interlayer may contain a hardening agent in a preferable amount of 0.1 to 10% by weight, more preferable amount of 0.5 to 5% by weight based on the weight of the interlayer. Examples of the hardening agent used in this invention are aldehydes (e.g., formaldehyde, glutaraldehyde, etc.,); ketones (e.g., diacetyl, cyclopentadione, 5,5-dimethylcyclohexane-1,3-dione, etc.,); triazine derivatives (e.g., 2-hydroxy-4,6-dichloro-1,3,5-triazine, 2-carboxy-4-chloro-6-methyl-1,3,5-triazine, 2-amino-4,6-dichloro-1,3,5-triazine, 5-acetyl-1,3-diacryloylhexahydro-1,3,5-triazine, 2(p-sulfophenyl)-4,6-dichloro-1,3,5-triazine); mucochloric acid; mucobromic acid; vinylsulfones (e.g., divinylsulfone, (bis(vinylsulfonylmethyl) ether, bis(vinylsulfonyl)methane, etc.,); diacryloylamine; isooxazoliums (e.g., 2-ethyl-5-(3-sulfonaphthophenyl)isooxazolium; 2,2'-diethyl-5,5'-p-phenylenediisooxazolium, etc.,); aziridines (e.g., 1,1'-hexamethylenebis(iminocarbonyl)-diaziridine); and the like. These and other compounds which can be used in this invention are described in, for example, C. K. Mees and T. H. James, "The Theory of the Photographic Process", 3rd edition, page 54 and below (published by The Macmillan Co., New York, 1966). Of the hardening agents, 2-hydroxy-4,6-dichloro-1,3,5-triazine is most preferred.

The coating solution for the interlayer is coated on a conductive layer containing cuprous iodide by a desired coating method and dried. Examples of useful coating methods for the interlayer include a dip coating method, an air knife coating method, a curtain coating method, an extrusion coating method, a roller coating method, a rotation coating method, a blade coating method, and a rod bar coating method. A typical example of a drying method involves evaporating water from the gelatin interlayer by properly blowing air of low humidity onto the layer while cooling the layer below about 30° C. directly after coating to set (gel) the gelatin interlayer.

The thickness of the gelatin interlayer after drying is 0.04 to 4 μm, preferably 0.1–2 μm. The thickness of the conductive layer and the photoconductive layer is preferaby 0.1 to 1 μm, and 1 to 30 μm, respectively.

Photoconductive layers generally used in connection with light-sensitive materials can be used in this invention. The photoconductive layers used in this invention are described, for example, in U.S. Pat. Nos. 4,283,475; 4,299,896; 4,297,426; and 4,272,598, and Published Unexamined German patent application (DE-OS) No. 2,733,911. When the conductive layer is the type wherein particles of a semiconductor such as cuprous iodide are dispersed in a resin as described in U.S. Pat. No. 3,245,833 (incorporated herein by reference to disclose such a layer) and also the photoconductive layer is formed by coating using an organic solvent, the features of the interlayer can be exhibited more effectively.

The invention will now be more practically explained by the following examples. However, the scope of the invention is not limited to these examples.

EXAMPLE 1

An acetonitrile solution containing 0.6% cellulose acetate butyrate and 2.3% cuprous iodide was coated on a polyethylene terephthalate (PET) film by means of a rod bar #5 to form a conductive layer having the thickness of 0.5 μm after drying. An aqueous solution of 2.5% gelatin was then coated on the conductive layer by means of a rod bar #5 to form an interlayer.

On the interlayer was coated a solution of 1 g of poly-N-vinyl carbazole (Luvican M 170, made by BASF A.G.) and 2.5 mg of 2,6-di-t-butyl-4-[4-(N-methyl-N-cyanoethylamino)styryl]thiopyrylium tetrafluoroborate dissolved in 15 ml of dichloroethane using a rod bar to form a photoconductive layer. The thickness of the photoconductive layer after drying was 29 μm and the absorbance thereof at a wave length of 630 n.m. was 0.11.

The sensitivity of the electrophotographic material thus obtained was measured. The sensitivity measurement was made with an electrostatic charge test apparatus SP-428 made by Kawaguchi Denki K.K., a xenon lamp was used as a spectral light source, and a monochromatic light of 630 n.m. in wave length was irradiated.

A positive charge of +280 volts was formed on the surface of the light-sensitive material thus prepared by corona discharging of +5 KV. The exposure amount (a half decay amount shown by $E_{50}$) required for decaying the surface charge to 140 volts by the light irradiation was 153 erg/cm$^2$.

COMPARISON EXAMPLE 1

An electrophotographic light-sensitive material was prepared by following the same procedure as in Example 1 except that a gelatin interlayer was not formed and the sensitivity thereof was measured. The half decay $E_{50}$ at positive charging was 270 erg/cm$^2$. Also, it was confirmed that the maximum negative charge which could be formed on the surface of the light-sensitive material by negative chrona discharging was −30 volts. Hence it was difficult to perform an electrophotographic process with the electrophotographic light-sensitive material.

EXAMPLES 2–4

Each of the following three kinds of subbing layers was coated on a PET film using a rod bar #5 and dried by heating with a warm blast.

Composition of the coating solution for the subbing layer:

Example 2: Aqueous emulsion of 5% copolymer of vinylidene chloride/methyl acrylate/hydroxyethyl acrylate (85:10:5).

Example 3: Dichloromethane solution of 2.5% polycarbonate of bisphenol A.

Example 4: Dichloromethane solution of 2.5% copolymer of vinylidene chloride/acrylonitrile.

Then, on each subbing layer was formed a conductive layer by coating thereon an acetonitrile solution of 3.5% cuprous iodide using a rod bar #5 and drying with a warm blast. On the conductive layer were formed a gelatin interlayer and a photoconductive layer of poly-N-vinylcarbazole-2,6-di-t-butyl-4,4-(N-methyl-N-cyanoethylamino)-styryl thiapyrylium tetrafluoroborate in this order as in Example 1. Thus, three kinds of electrophotographic light-sensitive materials were prepared. The electrophotographic characteristics of the three kinds of electrophotographic light-sensitive materials are described in Table 1.

TABLE 1

| | Positive charge | | Negative charge | |
|---|---|---|---|---|
| Example No. | Surface potential (volt) | $E_{50}$ (erg/cm$^2$) | Surface potential (volt) | $E_{50}$ (erg/cm$^2$) |
| 2 | +280 | 131 | −280 | 128 |
| 3 | +280 | 126 | −280 | 117 |
| 4 | +280 | 121 | −280 | 121 |

COMPARISON EXAMPLES 2–4

Three kinds of electrophotographic light-sensitive materials were prepared by following the same procedures as in Examples 2–4 except that a gelatin interlayer was not formed in Example 2–4. The electrophotographic characteristics of the three kinds of light-sensitive materials are shown in Table 2 (the light-sensitive material of a comparison example No. had the same subbing layer of the light-sensitive material having the same example No.)

TABLE 2

| | Positive charge | | Negative charge | |
|---|---|---|---|---|
| Comparison Example No. | Surface potential (volt) | $E_{50}$ (erg/cm$^2$) | Surface potential (volt) | $E_{50}$ (erg/cm$^2$) |
| 2 | +280 | 750 | −150 | 750 |
| 3 | +280 | 360 | −30 | 1200 |
| 4 | +280 | 214 | −20 | >1500 |

As is apparent from the Table 2, in the case of the light-sensitive materials of the comparison examples having no inter layers, the sensitivity lowers markedly comparing with results of Examples 2 to 4 and it is very difficult to form negative charging on the surface thereof.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a conductive layer containing cuprous iodide, a gelatin layer consisting essentially of gelatin, and a photoconductive layer formed in this order.

2. The electrophotographic light-sensitive material as claimed in claim 1, wherein the conductive layer is a layer of cuprous iodide particles dispersed in a polymer.

3. The electrophotographic light-sensitive material as claimed in claim 1, wherein the conductive layer is formed on a support.

4. The electrophotographic light-sensitive material as claimed in claim 1, wherein the conductive layer is formed on a subbing layer composed of a hydrophobic polymer the subbing layering being formed on a support.

5. The electrophotographic light-sensitive material as claimed in claim 1, wherein the gelatin layer has a thickness of from 0.04 to 4.0 μm.

6. The electrophotographic light-sensitive material as claimed in claim 5, wherein the thickness of the gelatin layer is from 0.1 to 2.0 μm.

* * * * *